United States Patent [19]

Broderson et al.

[11] 4,401,855

[45] Aug. 30, 1983

[54] APPARATUS FOR THE LINEAR PREDICTIVE CODING OF HUMAN SPEECH

[75] Inventors: Robert W. Broderson, Oakland; Paul J. Hurst, San Leandro; Ronald D. Fellman, Berkeley, all of Calif.

[73] Assignee: The Regents of the University of California, Berkeley, Calif.

[21] Appl. No.: 211,115

[22] Filed: Nov. 28, 1980

[51] Int. Cl.[3] ..... G10L 1/06

[52] U.S. Cl. ..... 179/15.55 R; 179/1 SA

[58] Field of Search ..... 179/1 SA, 1 SC, 1 D, 179/15.55 R, 15.55 T

[56] References Cited

U.S. PATENT DOCUMENTS

| | | | |
|---|---|---|---|
| 3,662,115 | 5/1972 | Saito et al. | 179/1 SA |
| 4,052,563 | 10/1977 | Noda et al. | 179/1 SA |
| 4,184,049 | 1/1980 | Crochiere et al. | 179/1 SA |
| 4,209,844 | 6/1980 | Brantingham et al. | 179/1 SA X |

FOREIGN PATENT DOCUMENTS

| | | | |
|---|---|---|---|
| 2069289 | 1/1980 | United Kingdom | 179/1 D |

OTHER PUBLICATIONS

*IEEE Journal of Solid-State Circuits*, vol. SC-14, No. 6, Dec. 1979; pp. 961-969; "A Two Chip PCM Voice CODEC with Filters", by Hague et al., IEEE Journal of Solid-State Circuits, Vol. SC-14, No. 6, Dec. 1979; pp. 970-980; CMOS Switched-Capacitor Filters for a PCM Voice CODEC, by Gregorian et al., IEEE Journal of Solid-State Circuits, Vol. SC-14, No. 6, Dec. 1979; pp. 981-991. A Single-Chip NMOS Dual Channel Filter for Telephony Applications, by Gray et al. Wiggins, Richard; *An Integrated Circuit for Speech Synthesis;* Conference: ICASSP 80 Proceedings, IEEE International Conference on Accoustics Speech and Signal Processing; 4/11/80.

*Primary Examiner*—G. Z. Rubinson
*Assistant Examiner*—Keith E. George
*Attorney, Agent, or Firm*—Robert W. Dilts

[57] ABSTRACT

Improved apparatus for the linear predictive coding of human speech in which the speech is sampled through the use of analog filters and the linear predictive coding computations are performed with respect to such samples using digital techniques. The filters are MOS switched capacitor filters which can be implemented on a silicon chip together with the digital circuitry. Specific circuits for implementing two different linear predictive coding speech analysis techniques are disclosed.

5 Claims, 7 Drawing Figures

APPARATUS FOR THE LINEAR PREDICTIVE CODING OF HUMAN SPEECH

The Government has rights in this invention pursuant to Contract No. N000173-77-C-0238 awarded by the Office of Naval Research.

DESCRIPTION

Technical Field

This invention relates to apparatus for the linear predictive coding of human speech and, more particularly, to improved linear predictive coding apparatus adapted to be implemented on a silicon chip area approaching minimum thereby providing substantial saving in power, cost and size.

Background Art

Linear prediction of speech or "linear predictive coding (LPC)" is an analysis method which extracts information about a human vocal tract transfer function from the speech waveform produced thereby. See Makhoul, J., 1975, "Linear Prediction: A Tutorial Review:", Proc. of IEEE pp. 561–580.

The major use of LPC analysis is for very narrow band digital transmission in which highly intelligible speech can be transmitted to a compatible receiver at data rates as low as 2.4K bits/sec. Another use which is gaining interest is in speech recognition since the LPC coefficients are a very compact representation of the fundamental information of a speech sound.

Among the LPC methods of the prior art is the adaptive filter technique described by Itakura, F. and Saita, S., "Analysis-Synthesis in Telephony Based on Maximum Liklihood Method", Reports of 6th Int. Cong. Acoust., Tokyo C-5-5-5, C17-20 (1968). Also among the prior art LPC methods is the adaptive autocorrelation analysis technique described by Barnwell, T., "Recursive Autocorrelation Computation for LPC Analysis", Proc. Int'l. Conf. on Acoustics, Speech, and Signal Processing, pp. 1–4 (1977). The implementation of these techniques according to the teaching of this invention will be described in detail herein.

The present invention is directed to the implementation of LPC methods and techniques in apparatus of small size with low power requirements at reduced cost.

Disclosure of the Invention

In one aspect of the present invention, improved apparatus for the linear predictive coding of human speech is provided wherein the steps involving filtering of the speech are implemented using analog sampled data techniques and the high accuracy computation steps are implemented using digital techniques, both of which are capable of being integrated on the same silicon chip.

BEST MODE FOR CARRYING OUT THE INVENTION

Linear Predictive Coding (LPC) models the human vocal tract resonances by fitting an all-pole transfer function to the vocal tract transfer function. The model has the following form (in z-transform notation):

$$H(z) = \frac{1}{1 - \sum_{1=i}^{p} a_i z^{-i}} \tag{1}$$

The number of poles (P) used in the model is typically nine to twelve, more poles improve the model accuracy, but a minimum number of poles is desired in order to obtain the maximum efficiency of representation.

The model parameters (or LPC coefficients) are the $a_i$'s. However, the $a_i$'s will not be calculated explicitly herein. Instead, coefficients will be calculated which are related to the $a_i$'s by simple recursive relations as taught by Markel, J. D. and Gray, A. H., *Linear Prediction of Speech,* Springer-Verlag, 1976.

Figure 1A:
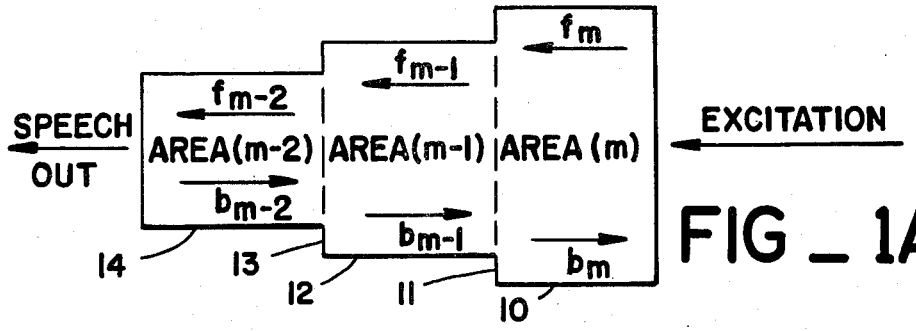
FIGS. 1A and 1B represent a model of a human vocal tract as a cascade of equal length tubes of different areas, with FIG. 1A illustrating the production of speech and FIG. 1B illustrating the analysis of speech.

Thus, referring to FIG. 1A, such coefficients may be derived directly from physical considerations by modeling the vocal tract as an integral cascade of equal length coaxial tubes of which three 10,12 and 14 are shown, each having a cross-sectional area independently varying in time in the path from excitation to speech output (i.e., right to left). The excitation may be either "voiced" sounds provided by vibration of the vocal cords (glottis) or "unvoiced" sound provided by a flow of air. The tubes 10, 12, 14 may correspond to the epiglottis, oral cavity and lips, for example.

When speech is being produced, forward, fm(t), and backward, bm(t), traveling sound pressure waves will be produced in the various parts of the vocal tract as modeled by the tubes 10, 12, 14. From conservation and continuity constraints, the following relationships between the forward and backward waves for the $m^{th}$ tubes can be seen to hold:

$$f_{m-1}\left(t + \frac{\tau}{2}\right) = (1 - r_m)f_m(t) - r_m b_{m-1}\left(t - \frac{\tau}{2}\right) \tag{2}$$

$$b_m(t) = r_m f_m(t) + (1 + r_m)b_{m-1}\left(t - \frac{\tau}{2}\right) \tag{3}$$

where $\tau/2$ is the amount of time required for the sound wave to travel the length of one tube, and where $$r_m = \frac{\text{Area}_{m-1} - \text{Area}_m}{\text{Area}_{m-1} + \text{Area}_m} \tag{4}$$

For ease of understanding, $r_m$ may be interpreted as the reflection coefficient of the sound pressure waves as they encounter the discontinuities at the junction 11, 13 between the equal length tubes 10, 12, 14.

By solving equation (2) for $f_m(t)$ and substituting into equation (3) we obtain $$(1 - r_m)b_m(t) = r_m f_{m-1}\left(t + \frac{\tau}{2}\right) + b_{m-1}\left(t - \frac{\tau}{2}\right) \tag{5}$$

Equations (2) and (5) together define the basic structure for an LPC speech synthesizer corresponding to the model shown in FIG. 1A.

Figure 1B:
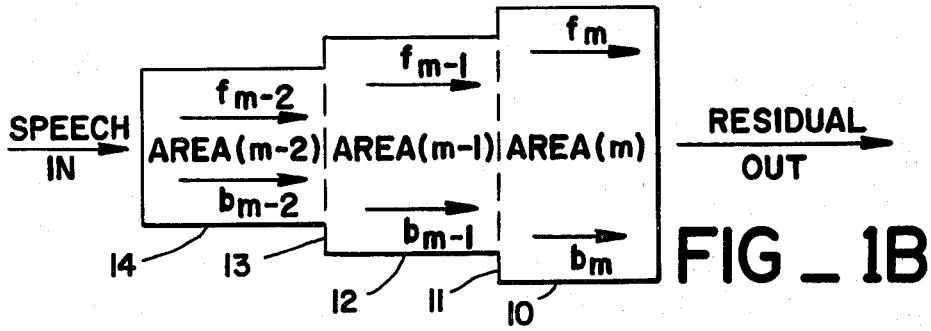

In order to derive an LPC speech analyzer as modeled in FIG. 1B, we wish to find the negative of the reflection coefficient $r_m$. Thus, we can set the correlation $k_m$ between the forward and the backward sound pressure waves in each pair of successive tubes in the model of FIG. 1B equal to $-r_m$ in equation (2). By simplifying and dropping the prefactor $(1-r_m)$, thus allowing for nonunity overall filter gain, equation (2) becomes:

$$f_{m-1}(t) = f_m\left(t - \frac{\tau}{2}\right) + k_m b_{m-1}(t - \tau) \tag{6}$$

We can now derive the LPC analyzer by solving equation (6) for $f_m(t)$ instead of $f_{m-1}(t)$ and by similarly rewriting equation (5) and inserting a delay of $\tau/2$ between successive stages to obtain the following pair of equations:

$$f_m(t) = f_{m-1}(t) - k_m b_{m-1}(t-\tau) \tag{7}$$

$$b_m(t) = b_{m-1}(t-\tau) - k_m f_{m-1}(t) \tag{8}$$

These equations define the lattice adaptive filter to be used in the LPC analyzer.

Figure 2:
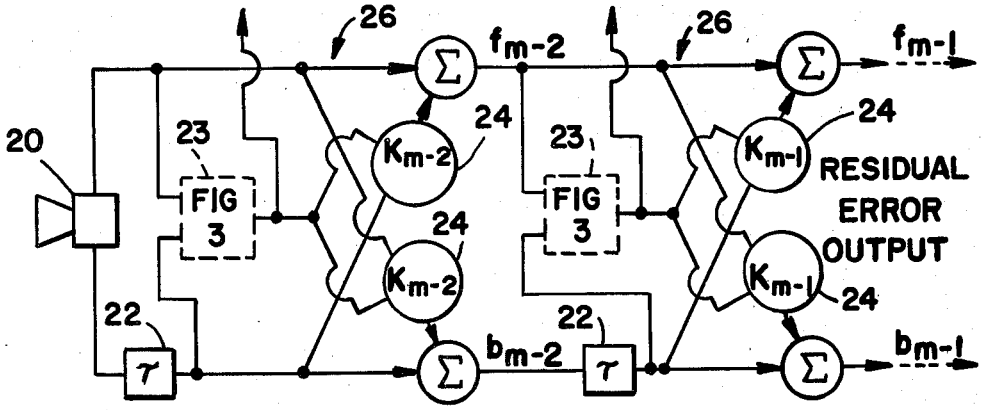
FIG. 2 is a block diagram of a lattice adaptive filter model corresponding to the model of FIG. 1B.

A block diagram of two stages of this filter structure is shown in FIG. 2. For a structure of p poles (equation 1), p stages of the form shown in FIG. 2 are cascaded.

The speech waveform which is being analyzed is converted to an electrical waveform by a microphone means 20 shown at the left-hand side of FIG. 2 and the output from the circuit at the right-hand side of FIG. 2, termed the "residual error output", will correspond to the excitation of the vocal tract which produced the speech waveform. Assuming that the average power of the residual output of each stage is minimized, then an expression for the $k_m$ of each stage can be derived by taking the expectation of the power of the residual error over a 20–30 ms time-window and then solving the following $$\frac{dE\,[f_m^2(t)]}{dk_m} = 0 \tag{9}$$

Substituting equation (7) into equation (9) and assuming that the input speech is a stationary process which allows $E[f_{m-1}^2(t)] = E[b_{m-1}^2(t-\tau)]$ yields:

$$k_m = \frac{2E[f_{m-1}(t)b_{m-1}(t-\tau)]}{E[f_{m-1}^2(t-\tau)] + E[b_{m-1}^2(t-\tau)]} \tag{10}$$

The k's computed according to equation (10) have been termed PARCOR coefficients because they are related to the partial correlation between the forward and backward sound pressure waves at each stage of the filter of the model of FIGS. 1A and 1B. Thus, to reduce the number of operations involved in computing such coefficients we can compute the corresponding area ratios instead, as follows:

$$\frac{\text{Area}_m}{\text{Area}_{m-1}} = \frac{1 - k_m}{1 + k_m} = \frac{E[(f_{m-1}(t) - b_{m-1}(t-\tau))^2]}{E[(f_{m-1}(t) + b_{m-1}(t-\tau))^2]} \tag{11}$$

Figure 3:
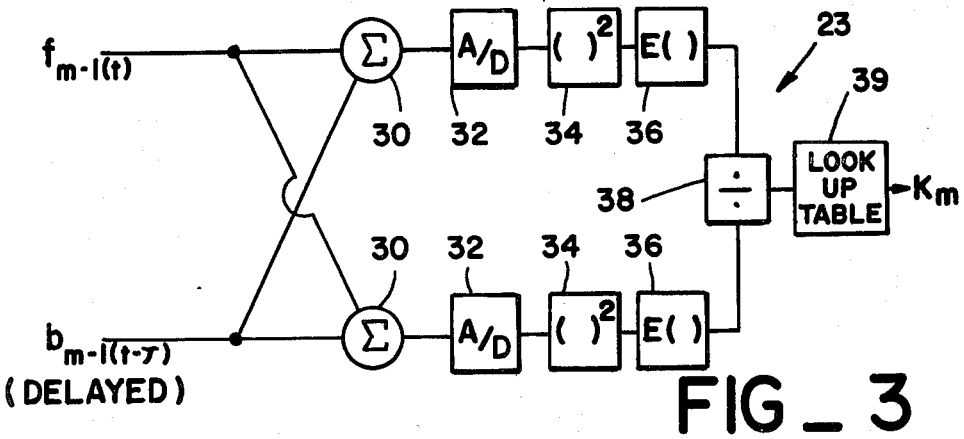
FIG. 3 is a block diagram of the digital logic used to compute coefficients of partial correlation between the outputs of the filter sections of FIG. 2.

The computation according to equation (11) is performed by the digital circuitry shown in block diagram form in FIG. 3. In other words, a digital circuit as shown in FIG. 3 is indicated by each of the dotted line boxes 23 in FIG. 2. Thus, the electrical waveform produced from the speech to be analyzed by the microphone 20 is split and one portion used directly to provide the $f_{m-3}(t)$ input with the other portion being delayed at 22 to provide the $b_{m-3}(t-\tau)$ input to the circuits of both FIG. 2 and FIG. 3. From this input the first circuit 23 of FIG. 3 computes a $k_m$ value for the control 24 of the first filter 26 of the circuit of FIG. 2. The output of the first filter 26 provides the $f_{m-2}$ and $b_{m-2}$ inputs to the next stage of the circuit of FIG. 2.

As shown in FIG. 3, the circuit 23 performs the calculation of equation 11. Thus, the $f_m(t)$ and $b_m(t)$ signals are sum and differenced at 30. Each is then converted from an analog to a digital signal at 32 and then squared at 34. The expectations E of the squared signals are taken at 36 and divided at 38 to produce the area ratio. The area ratio is converted to the corresponding $k_m$ through the use of a look-up table provided by a simple read only memory 39 and applied to subsequent filter stages 26 of the circuit as shown in FIG. 2.

Figure 4:
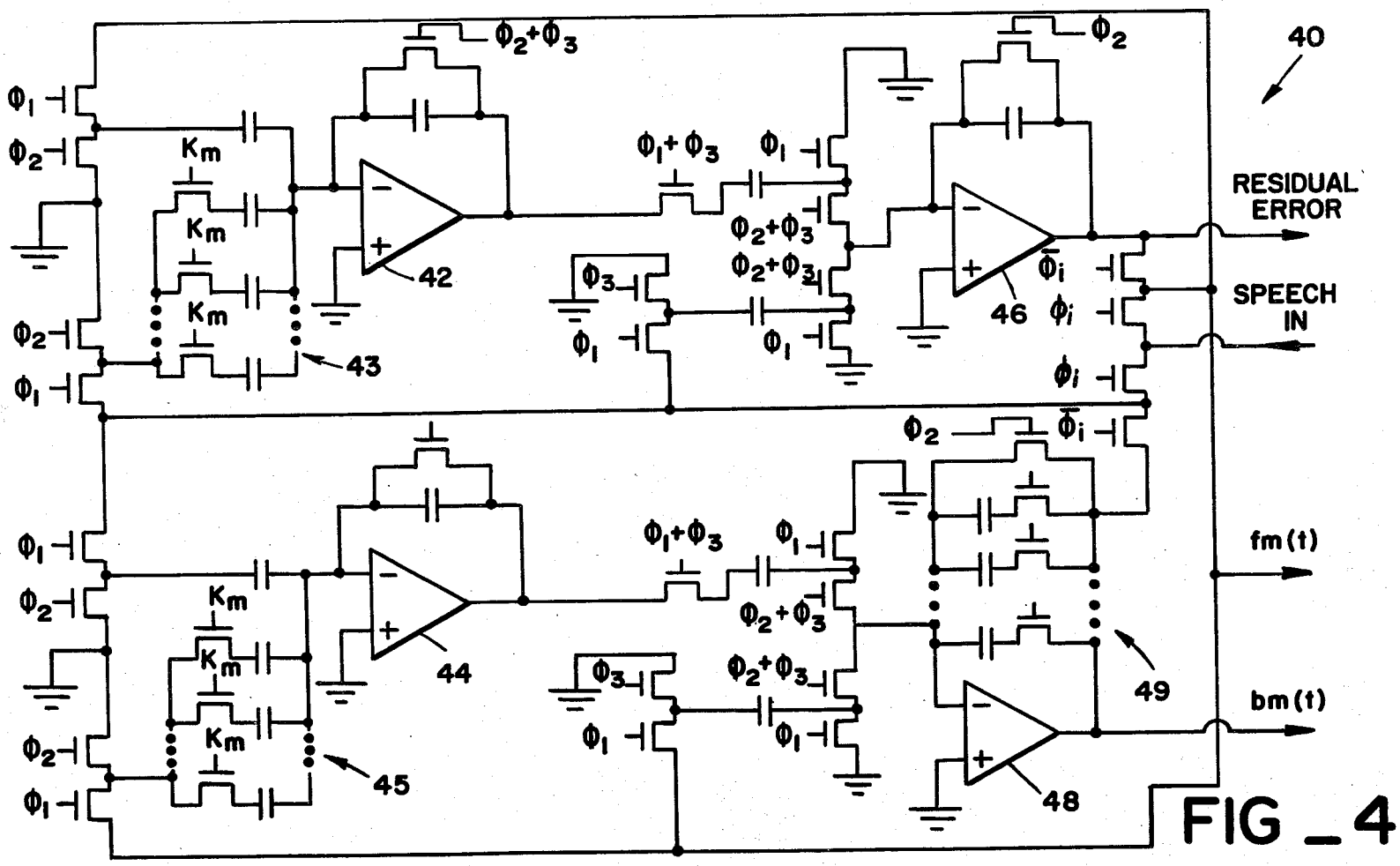
FIG. 4 is a schematic diagram of the implementation of the block diagrams of FIGS. 2 and 3 on a single silicon chip using switched-capacitor analog circuitry for the filter section thereof.

Referring to FIG. 4 a lattice adaptive filter 40 using multiplexed switched capacitor analog circuitry for the filters 26 of FIG. 2 including the circuit 23 of FIG. 3 is shown. The filter is an analog sampled-data filter which uses capacitors for signal storage and ratioed capacitors for multiplication. By multiplexing a single stage, a ten stage filter will only require four op-amps 42, 44, 46, 48 and two sample and hold buffers. The settling time, gain and noise requirements of the amplifiers, even with the multiplexing, are easily within the range of MOS implementation. In this regard, the teachings of Allstot, D. J., Broderson, R. W., and Gray, P. R., "MOS Switched Capacitor Ladder Filters", IEEE JSSC 806–814 (1978) is incorporated herein by reference.

A key factor which allows the filter to be realized with small chip area (i.e., under 5000 mil$^2$) and low power requirement (i.e., less than 100 mw) is that the two multiplications of a lattice stage are performed by the simple op-amp gain stages 42 and 44. The desired gain is the PARCOR coefficient, $k_m$, which is set by the particular combination of binary weighted capacitors 43, 45 which are connected into the op amp unit. In order to obtain four quadrant operation, a type of offset binary coding may be used.

Because of offsets associated with the op-amps and charge injection due to parasitic capacitances of the switches, automatic offset cancellation is desirable. By inverting the signal every stage and by storing offsets on capacitors through appropriate switch phasing, the effect of offsets have been minimized in the circuit of FIG. 4.

Op-amps 46 and 48 perform the sums in equations (7) and (8) while op-amp 48 also performs the delay by $\tau$ which is taken to be one sample period (125 μsec according to this embodiment). The delay is implemented by commutating through P+1 capacitors 49 for a P stage filter.

The outputs of the filter 40, $f_m(t)$ and $b_m(t-\tau)$ are connected to the circuit 23 of FIG. 3 as discussed hereinabove. The A/D converter 32 is preferably a companding converter such as an 8-bit μ-law PCM coder. The μ-law is an approximate floating point representation which is exploited in the subsequent squaring operation 34 by using a ROM to square the mantissa and a shift to form the squared exponent. The calculation of the power expectation 36 is performed by a simple digital filter of the form:

$$V_{out}(t) = \frac{63}{64} V_{out}(t-\tau) + \frac{V_{in}(t)}{64} \tag{12}$$

At 38 the outputs of the two filters 36 are reconverted to a floating point representation and the division is performed by a combination of ROM and a subtraction. The output at this point is an area ratio and is converted at 39 to the $k_m$'s through table look-up in a ROM. Eight bits accuracy for the k's at this point has been found to be adequate.

The total amount of circuitry for the above described digital functions 32 through 39 is about 2500 gates and 5K bits of ROM. This amount of circuitry may be easily integrated onto the same chip as the switched capacitor filter of FIG. 4.

Another approach to the calculation of the LPC coefficients is the autocorrelation approach. This approach requires the computation of p+1 autocorrelation values of the speech waveform computed over a period sufficiently short that the speech characteristics only change slightly (i.e., 20–30 ms, for example). The autocorrelation values can be transformed into the LPC coefficients by the solution of a set of linear equations which can be done efficiently using Durbins recursion algorithm.

The conventional approach to calculating the autocorrelation values is to sample the speech in time, where s(i) is the $i^{th}$ sample, and then multiply the speech waveform by a smooth window function w(i). A commonly used window function is the Hamming window which is typically nonzero only over a finite time interval. The windowed speech is then used in the standard formula for the autocorrelation function as follows:

$$R(k) = \sum_{i=-\infty}^{\infty} s_\omega(i) s_\omega(i-k) \tag{13}$$

Figure 5:
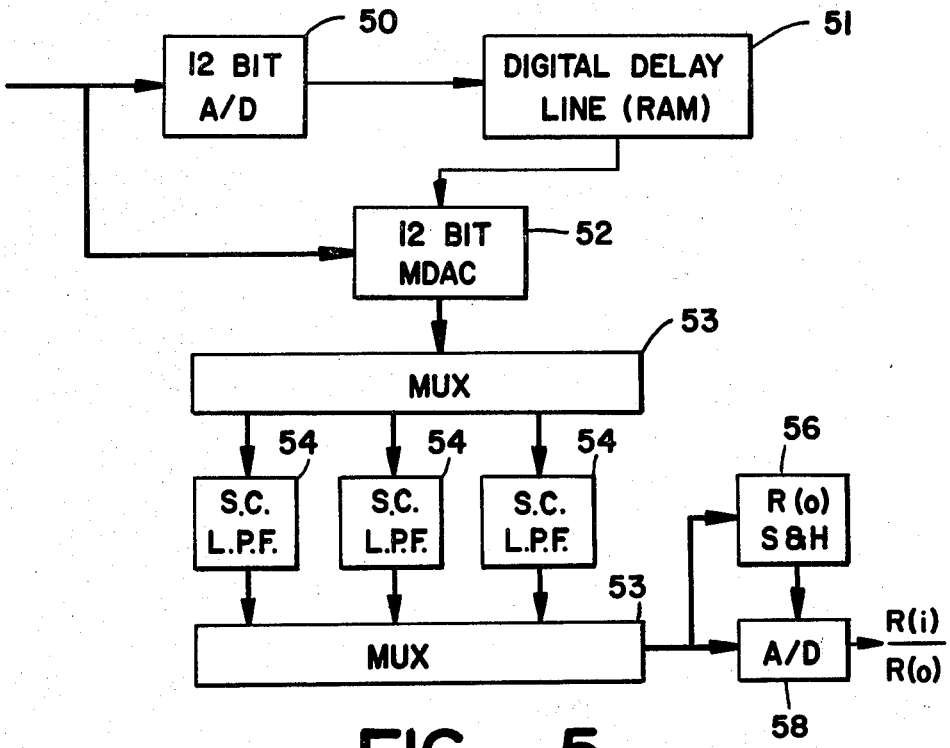
FIG. 5 is a block diagram of an adaptive autocorrelation system for the linear predictive coding of human speech.

Referring to FIG. 5, a system for calculating the autocorrelation values according to equation (13) is shown in block diagram form. In such block diagram the heavy lines indicate analog signal paths and the thin lines indicate digital signal paths.

According to the system of FIG. 5, equation (13) is performed by first forming the product of s(i) and s(i−k) and then performing the windowing of the product. Thus a portion of the sampled signal is converted to a twelve bit digital signal at 50 which digital signal is delayed at 51. The product of the undelayed sampled analog signal with the delayed digital signal is formed at 52 by multiplication in a multiplying digital to analog converter. Thus the analog input at 52 is multiplied with p+1 delayed signals (for a p-pole model) to yield p+1 products. These products are then multiplexed 53 through p+1 lowpass filter circuits 54 which apply the appropriate window function to each product. It has been found that the window function need not be zero outside its desired width so long at it decays to very small values outside such width. Thus a window which is the impulse response of a second order filter having an infinite time length can be used.

The desired window:

$$w(n) = \begin{cases} (1-n)\alpha^{-n} & n \leqq 0 \\ 0 & n > 0 \end{cases} \tag{14}$$

is the time reversed impulse response of a second order filter having two coincident real poles:

$$W(z) = \frac{1}{(1-\alpha z^{-1})^2} \tag{15}$$

To find the $k^{th}$ autocorrelation lag R(j,k) computed at time j, we must calculate:

$$R(j,k) = \Sigma\, s(i)w(j-i)s(i-k)w(j-i-k) \tag{16}$$
$$k = 0, 1, \ldots, p$$

Now define:

$$s'(i,k) = s(i)s(i-k) \tag{17}$$
$$w'(i,k) = w(i)w(i-k)$$

Then we can write equation (16) as follows:

$$R(j,k) = \sum_{i=-\infty}^{\infty} s'(i,k)w'(j-i,k) \quad k = 0,1,\ldots,p \tag{18}$$

From the above equation (18) it can be seen that R(j,k) is the convolution of s'(i,k) with w'(i,k).

By producing the sequence s'(i,k) and passing it through a linear, time invariant filter with impulse response w'(i,k), the autocorrelation function for lag k at time j will be calculated. Producing the sequence s'(i,k) requires only delay and multiplication.

Since multiplication in the time domain corresponds to convolution in the z-transform domain, we can get $W'_k(z)$ from equation (17) as follows:

$$W'_k(z) = W(z) * z^{-k} W(z) = \frac{1}{2\pi j} \int W(v)\left(\frac{z}{v}\right)^{-k} W\left(\frac{z}{v}\right) v^{-1} dv \tag{19}$$

This integral can be evaluated to give:

$$W'_k(z) = \frac{(k+1)a^k + (1-k)a^{k+2}z^{-1}}{(1-a^2z^{-1})^3} \tag{20}$$

which yields the transfer function of the filters. Note that each value of k corresponds to a different filter. All the filters have three poles at $a^2$ and one real zero. It has been found experimentally that the value a=0.98 is the best choice for a 9 pole LPC model with an 8 kHz sampling rate.

A portion of the analog output of the filters is multiplexed at 53 into a sample and hold circuit at 56. The output of the sample and hold circuit 56 and the instantaneous multiplexed output of the filters are passed through an analog to digital converter at 58 to provide a relative signal which is coupled to a microprocessor adapted to perform Durbins recursion algorithm in order to compute the reflection coefficients corresponding to the relative output signal derived according to the standard formula given as equation (13) hereinabove for the autocorrelation function.

Figure 6:
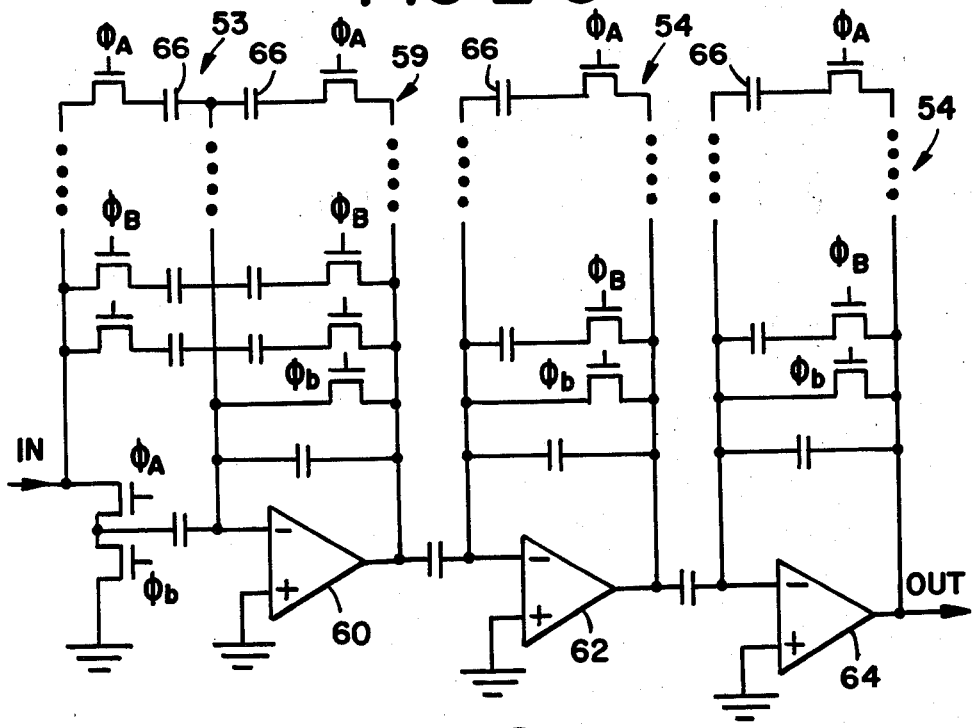
FIG. 6 is a schematic diagram of a switched capacitor implementation of the system of FIG. 5 suitable for integration on a single silicon chip.

FIG. 6 shows switched capacitor filter sections which may be used in the circuit of FIG. 5. The transfer function of each filter section is:

$$G(z) = A\frac{1 - bz^{-1}}{1 - cz^{-1}};\ A = -\frac{C_z}{C_R + C_{fb}};\ b = 1 - c\frac{C_z}{C_i};\ c = \frac{1}{1 + \frac{C_R}{C_{fb}}} \quad (21)$$

Cascading three such filter sections 54, 59 allows realization of the transfer function $W'_k(z)$. Note that the pole and zero of each filter section is determined entirely by capacitor ratios. Thus the filter sections are well suited for integration using standard MOS techniques which enable capacitor ratios to be defined very accurately, (i.e., ratio errors $<0.2\%$).

To minimize the effect of the nonlinear junction capacitance associated with the MOS switches, the filters may be designed to be insensitive to parasitics. This usually requires one operational amplifier per pole, or a total of 30 op amps for the 9 pole LPC system. However, due to the low switching rate of the switched-capacitor filters (8 kHz), the 30 dedicated op amps can be replaced by three time shared op amps 60, 62, 64. With such a scheme, each integrating capacitor 66 is connected across an op amp for 10 microseconds. During the remaining 115 microseconds the integrating capacitor 66 is disconnected from the op amp and stores the signal charge.

Since MOS op amps have relatively large input offset voltages (10–50 mV), the filters are designed to cancel the offset voltage using an offset nulling technique. Such switching scheme also provides cancellation of the op amp's low frequency noise (1/f noise).

The filter sections of 54 of FIG. 6 together with the multiplexing circuitry 53 and digital circuitry 50, 51, 52, 56 and 58 of FIG. 5 may easily be integrated on a minimum silicon chip area. The multiplying digital to analog converter 52 of FIG. 5 may be the same circuit which is used for the multiplication in the lattice filter structure of FIG. 4.

From the above it will be seen that two different approaches to the performance of linear predictive analysis have been embodied in circuitry according to the teaching of this invention. A careful trade-off has been made between analog and digital implementation so that the embodiments may be implemented in MOS-LSI form requiring the least possible silicon area and power while providing adequate performance. It is believed that those skilled in the art will make obvious modifications in the specific embodiments disclosed hereinabove without departing from the teaching of this invention.

What is claimed is:

1. In apparatus for the linear predictive coding of human speech in which analog data processing and LPC computations are performed on said speech, the improvement wherein:

(a) switched capacitor filter means comprising a plurality of multiplexed low pass filters is used for performing said analog data processing, and (b) digital circuitry is used for performing said LPC computations, said switched capacitor filter means and said digital circuitry being implemented on one or more silicon chips, and wherein said digital circuitry comprises an analog to digital converter connected to a digital delay line and a multiplying digital to analog converter, said speech providing the input to said analog to digital converter and digital delay line and an input to said multiplying digital to analog converter and the output of said delay line providing the other input to said multiplying digital to analog converter, the output of said multiplying digital to analog converter providing the input to said plurality of multiplexed low pass filters, whereby the output of said plurality of multiplexed low pass filters are the autocorrelation values of said speech.

2. The improvement of claim 1 wherein said digital circuitry comprises:

(a) a companding A/D converter;

(b) a ROM look-up table means for squaring the mantissa of the companded output of the A/D converter;

(c) a one-bit shift means for squaring the exponent of the companded output of the A/D converter;

(d) digital means for converting the combined output of said ROM means and shift means from floating point to fixed point representation;

(e) digital means for taking the statistical expectations of said fixed point representations;

(f) digital means for converting said statistical expectations from fixed to floating point representations;

(g) digital means for subtracting the exponents of said floating point representations of said statistical expectations.

3. The improvement of claim 2 wherein a ROM look-up table means is provided to convert the output of said digital circuitry to values representative of corresponding PARCOR coefficients.

4. In apparatus for the linear predictive coding of human speech in which analog data processing of said speech and LPC computations based upon said analog data processing are performed, the improvement wherein:

(a) switched capacitor filter means is used for performing said analog data processing of said speech, said filter means being a lattice adaptive filter structure the operation of which in terms of a given vocal tract modeled as a cascade of equal length tubes each having a cross-sectional area independently varying in terms is described by the equations:

$$f_m(t) = f_{m-1}(t) - k_m b_{m-1}(t-\tau)$$

$$b_m(t) = b_{m-1}(t-\tau) - k_m f_{m-1}(t)$$

where $f_m$ is a forward traveling sound pressure wave in a given one of said cascade of equal length tubes, $b_m$ is a backward traveling sound pressure wave in said given one of said cascade of equal length tubes, $f_{m-1}$ is a forward traveling sound pressure wave in an adjacent one of said cascade of equal length tubes, $b_{m-1}$ is a backward traveling wave in said adjacent one of said cascade of equal length tubes, (t) is a given time, $\tau$ is twice the amount of time required for said forward sound pressure wave to travel through said given tube of said cascade of equal length tubes and $k_m$ is the negative of the reflection coefficient of a sound wave as it encounters the discontinuity at the junction between said given tube and said adjacent tube of said cascade of equal length tubes; and (b) digital circuitry is used for performing said LPC computations based upon said analog data processing of said filter means, said switched capacitor filter means and said digital circuitry being implemented on one or more silicon chips.

5. The improvement of claim 4 wherein said lattice adaptive filter performs the sum and differencing and said digital circuitry performs the remaining operations of the following linear predictive coding area ratio equation:

$$\frac{E[(f_{m-1}(t) - b_{m-1}(t-\tau))^2]}{E[(f_{m-1}(t) + b_{m-1}(t-\tau))^2]} = \frac{1-k_m}{1+k_m} = \frac{\text{area}\cdot m}{\text{area}_{m-1}}$$

where E is the statistical expectation function integrated over a 20–30 ms time-window.

* * * * *

UNITED STATES PATENT AND TRADEMARK OFFICE

CERTIFICATE OF CORRECTION

PATENT NO. : 4,401,855

DATED : August 30, 1983

INVENTOR(S) : Robert W. Broderson, Paul J. Hurst, Ronald D. Fellman

It is certified that error appears in the above—identified patent and that said Letters Patent is hereby corrected as shown below:

Column 3 - Equation (9) should read: $\frac{dE\,[f_m^2(t)]}{dk_m} = 0$

Column 3, line 60 - equation should read:

$$E[f_{m-1}^2(t)] = E[b_{m-1}^2(t-\tau)]$$

Signed and Sealed this

*Twenty-seventh* Day of *December 1983*

[SEAL]

*Attest:*

GERALD J. MOSSINGHOFF

*Attesting Officer*

*Commissioner of Patents and Trademarks*